US005928787A

United States Patent [19]

Owatari et al.

[11] Patent Number: 5,928,787

[45] Date of Patent: Jul. 27, 1999

[54] INK JET RECORDING MEDIUM

[75] Inventors: Akio Owatari; Hiroyuki Onishi; Junichi Iida, all of Nagano; Yukio Kobayashi; Yoshihiro Kuroyama, both of Tokyo; Hiroki Midorikawa, Fukushima, all of Japan

[73] Assignees: Seiko Epson Corporation; Nippon Paper Industries Co., Ltd., both of Tokyo, Japan

[21] Appl. No.: 08/631,229

[22] Filed: Apr. 12, 1996

[30] Foreign Application Priority Data

| | | | |
|---|---|---|---|
| Apr. 14, 1995 | [JP] | Japan | 7-89547 |
| Apr. 14, 1995 | [JP] | Japan | 7-113761 |
| Mar. 29, 1996 | [JP] | Japan | 8-103897 |

[51] Int. Cl.[6] ..... B41M 5/00

[52] U.S. Cl. ..... 428/409; 428/195; 428/447

[58] Field of Search ..... 428/195, 211, 428/212, 341, 342, 447, 409

[56] References Cited

U.S. PATENT DOCUMENTS 5,372,884 12/1994 Abe et al. .

FOREIGN PATENT DOCUMENTS

| | | | |
|---|---|---|---|
| 61-89082 | 5/1986 | Japan | B41M 5/00 |
| 6-55830 | 3/1994 | Japan | B41M 5/00 |

*Primary Examiner*—Pamela R. Schwartz

*Attorney, Agent, or Firm*—Sughrue, Mion, Zinn, Macpeak & Seas, PLLC

[57] ABSTRACT

An ink jet recording medium is disclosed, comprising a base having provided on one side thereof a recording layer having an ink receiving layer whose surface is smoother than plain paper's and on the other side thereof a coating layer comprising an aqueous binder containing 10 to 40% by weight of a higher fatty acid salt to a coating weight of 0.1 to 0.3 $g/m^2$. An ink jet recording medium is also disclosed, comprising a base having provided on only one side thereof a recording layer, said recording layer having a coefficient of dynamic friction of 0.65 to 0.75 in mutual friction, the back surface of said base having a coefficient of dynamic friction of 0.15 to 0.25 in mutual friction, and the coefficient of static friction between said recording layer and said back surface is 0.55 to 0.65. The ink jet recording medium is prevented from being double-fed and can be transferred at improved precision, thereby providing high quality images. The ink jet recording layer is freed from feed trouble and can be transferred at improved precision, thereby providing images of high resolving power.

10 Claims, 5 Drawing Sheets

INK JET RECORDING MEDIUM

BACKGROUND OF THE INVENTION

1. Field of the Invention

The present invention relate to an ink jet recording medium (hereinafter sometimes referred simply to as a "recording medium"). More particularly it relates to an ink jet recording medium comprising a base having on one side thereof a recording layer, on which ink (mostly an aqueous ink) is jetted in dots to form an image. In particular, the invention relates to an ink jet recording medium suitable for formation of a full color image of high resolving power.

2. Description of the Prior Art

An ink jet recording system comprises jetting ink droplets onto a recording medium to form a dot image (inclusive of letters). The system is less noisy than a dot impact type recording system, can be applied to full color printing with ease, and makes high-speed printing possible. The recent advancement of the ink jetting technique has achieved further improvements of recording characteristics, particularly resolving power.

Recording media to be used in the ink jet recording system include plain paper and coated paper.

Coated paper is generally composed of a paper base and a porous ink receiving layer. The ink receiving layer comprises a pigment, a binder, and additives. Pigments having porosity and a low refractive index are used for assuring high ink absorbing properties and a high color density, and amorphous silica is of the most frequent use. Water-soluble resins having satisfactory film forming properties are used as binder for assuring fixing strength and ink absorbing properties, and polyvinyl alcohol (hereinafter abbreviated as PVA) and polymer latices are frequently used. The additives used include cationic resins for improvement of water resistance, photo stabilizers for improvement of light resistance, and fluorescent brightening agents for improvement of whiteness.

Such coated paper provides images with a higher color density and a clearer hue, i.e., higher color reproducibility, than plain paper. Further, a so-called feathering phenomenon (dendrical runs of ink along cellulose fibers) is inhibited to improve dot roundness. Furthermore, the dot diameter can be controlled by selecting the components of the ink receiving layer to further increase the resolving power.

Therefore coated paper is suitable for obtaining color images of high resolving power. However, the ink receiving layer of coated paper tends to cause spreading of jetted ink droplets because of its high water absorbing properties, which has been a limit in further improving the resolving power.

In order to suppress ink's spreading in the ink receiving layer to further improve the resolving power, a recording medium having an ink receiving layer covered with a water-repellent layer has been proposed as disclosed in JP-A-61-89082 (the term "JP-A" as used herein means an "unexamined published Japanese patent application").

JP-A-6-55830 discloses a method for improving running properties of a recording medium by coating the back side of a paper base with an aqueous high polymeric resin containing 0.1 to 10% by weight of an aliphatic hydrocarbon lubricant or a metal soap lubricant to a coating weight of 0.4 to 6 g/m$^2$. The publication has a mention that use of the lubricant in an amount exceeding 10% by weight excessively decreases the coefficient of friction to cause slippage, another running trouble.

Coated paper, when piled up, tends to adhere to each other on account of the smooth surface as compared with plain paper. Ink jet recording apparatus are often equipped with a paper feed tray in which a large number of recording media are put in a pile and from which each recording medium is fed by means of a feed roll. If coated paper is set in a pile in the tray, there is a fear of double feeding (two or more sheets of paper are fed at a time) due to the adhesion or frictional force.

The above-mentioned recording medium having an ink receiving layer covered with a water-repellent layer is apt to gather moisture on the water-repellent layer on being exposed in a high humidity environment and tends to cause blocking (adhesion) when piled up due to adsorbing action of the moisture. Therefore, when the recording media of this type are set in a paper feed tray in a pile, there is a fear of double feeding.

SUMMARY OF THE INVENTION

Accordingly, a first object of the present invention is to solve the above problem associated with coated paper and to provide an ink jet recording medium which has a smoother surface than plain paper's and yet causes no double feeding.

A second object of the invention is to solve the above problem associated with coated paper having a water-repellent layer and to provide an ink jet recording medium which has an ink receiving layer covered with a water-repellent layer and yet causes no double feeding.

The first object of the invention is accomplished by as the first embodiment, an ink jet recording medium comprising a base having on one side thereof a recording layer having a porous ink receiving layer with a smoother surface than plain paper's and on the other side thereof a coating layer comprising an aqueous binder containing 10 to 40% by weight of a higher fatty acid salt to a coating weight of 0.1 to 0.3 g/m$^2$.

The second object of the invention is accomplished by as the second embodiment, an ink jet recording medium, in which the recording layer is composed of an ink receiving layer and a water-repellent layer covering the ink receiving layer, the recording medium being characterized by having the construction of the first embodiment.

The ink jet recording medium as the third embodiment of the invention is the one described in the second embodiment which is further characterized in that the water-repellent layer is formed of a silicone.

The first object of the invention is also accomplished by as the fourth embodiment, an ink jet recording medium comprising a base having provided on only one side thereof a recording layer, which is characterized in that the coefficient of dynamic friction between the recording surfaces is 0.65 to 0.75, the coefficient of dynamic friction between the back surfaces of the base is 0.15 to 0.25, and the coefficient of static friction between the recording surface and the back surface of the base is 0.55 to 0.65.

The second object of the invention is also accomplished by as the fifth embodiment, an ink jet recording medium, in which the recording surface has a silicone water-repellent layer, the recording medium being characterized by having the construction of the fourth embodiment.

The ink jet recording medium as the six embodiment is the one described in the fourth or fifth embodiment, which is further characterized in that the back side of the base has a coating layer comprising 60 to 80% by weight of an aqueous binder and 20 to 40% by weight of a higher fatty acid salt.

The ink jet recording medium as the seventh embodiment is the one described in any one of the above embodiments, which is further characterized in that the base is paper.

BRIEF DESCRIPTION OF THE DRAWINGS

Further details are explained below with the help of the examples illustrated in the attached drawings in which.

DETAILED DESCRIPTION OF THE INVENTION

The ink jet recording medium of the first embodiment has provided on one side of a base a recording layer having an ink receiving layer with a smoother surface than plain paper. The ink dots jetted onto the recording layer form an image, especially a color image of high resolving power.

The higher fatty acid salt contained in the coating layer provided on the other side of the base serves as lubricant. Therefore, when a large number of the recording media are set in a pile in a paper feed tray of an ink jet recording apparatus and individually fed to the recording apparatus by means of a feed roll, a single recording medium can be fed with a good slip on the underlying one so that double feeding rarely occurs.

In addition, the fact that the higher fatty acid salt is present in the coating layer in a specific amount of 10 to 40% by weight and that the coating layer is provided at a specific coating weight of 0.1 to 0.3 g $m^2$ produces additional effects as hereinafter described.

Figure 1:
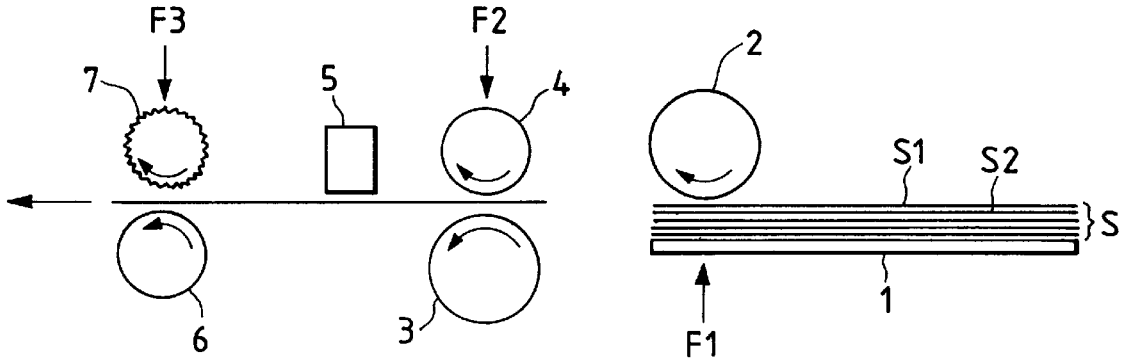
FIG. 1 illustrates a schematic view of a general ink jet recording apparatus.
Figure 2:
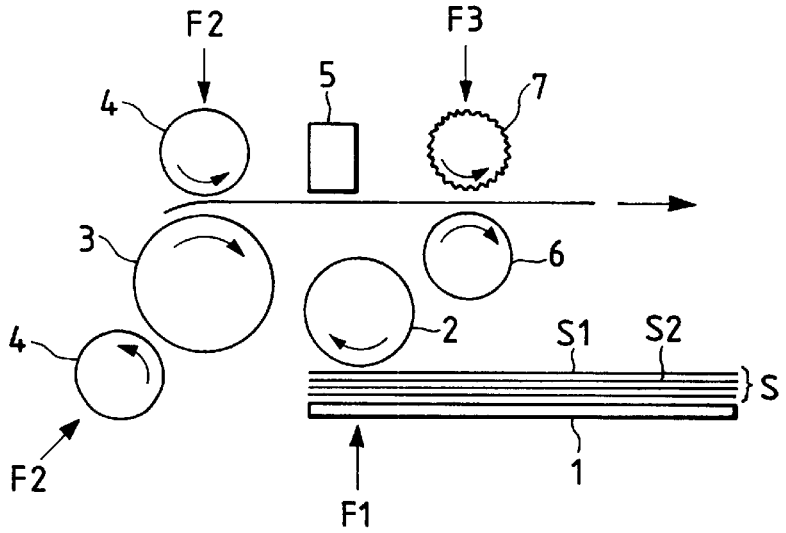
FIG. 2 illustrates a schematic view of another general ink jet recording apparatus.

Generally known ink jet recording apparatus are shown in FIGS. 1 and 2. In FIG. 1, reference numeral 1 indicates a paper feed tray; 2, a feed roll; 3, a transfer roll; 4, a pinch roll; 5, an ink jet head; 6, a discharge roll; and 7, a roulette wheel.

A plurality of recording media S are set in a pile in paper feed tray 1. At the time of paper feeding, paper feed tray 1 lifts to press recording media S onto feed roll 2 under a prescribed force, F1.

Feed roll 2 is a roll with at least the surface of which being made of rubber (hereinafter referred to as a rubber roll). Feed roll 2 revolves to feed uppermost recording medium S1.

Transfer roll 3 is a rubber roll onto which pinch roll 4 is pressed under a prescribed force, F2. Of rolls 3 and 4, at least transfer roll 3 is a driven roll. Recording medium S is thus transferred as sandwiched between transfer roll 3 and pinch roll 4.

Ink jet head 5 is to spout ink droplets toward recording medium S to form an image.

Discharge roll 6 is a rubber roll to which roulette wheel 7 (a star wheel made of thin plate) is pressed under a prescribed force, F3. Discharge roll 6 is a driven roll, while roulette wheel 7 is usually a follower. The recording medium after image formation is thus transferred and discharged as sandwiched between discharge roll 6 and roulette wheel 7.

The peripheral speed of discharge roll 6 is slightly higher than that of transfer roll 3 so that recording medium S during recording is transferred under moderate tension. Therefore, the transfer force by discharge roll 6 has an influence on the transfer precision of the recording medium during recording.

In FIG. 2, the same reference numerals as used in FIG. 1 are given to the same members. The difference of the apparatus shown in FIG. 2 from that of FIG. 1 is the traveling route of recording medium S. That is, in FIG. 2 recording medium S fed from paper feed tray 1 is caught by transfer roll 3 and reversed, and then discharged to the same side as the paper feeding side.

In carrying out recording with such an apparatus as shown in FIG. 1 or 2, recording media S must be fed one by one by means of feed roll 2. Further, in order to obtain an image of high resolving power, the precision in transferring the recording medium by transfer roll 3 and discharge roll 6 should be high enough. For example, in order for ink droplets (dots) to be struck against the recording medium exactly at a prescribed position to a recording precision of 10 $\mu$m, the recording medium transfer precision must be as high as the recording precision.

Recording media is set in paper feed tray 1 with their recording side up in the apparatus of FIG. 1, while down in the apparatus of FIG. 2. In either type of apparatus, the recording media set in paper feed tray 1 have their recording surface (surface side) in contact with the back side. After recording, the recorded side is brought into contact with roulette wheel 7.

Assuming that the coating layer of recording medium S contains less than 10% by weight of a higher fatty acid salt, recording medium S1, i.e., the uppermost sheet to be fed, hardly slips on recording medium S2 which is beneath recording medium S1 in contact therewith. As a result, recording medium S2 is apt to accompany recording medium S1 to cause double feeding.

If, on the other hand, the amount of the higher fatty acid salt in the coating layer exceeds 40% by weight, uppermost recording medium S1 to be fed easily slips on underlying recording medium S2, but a different problem arises as follows.

In the apparatus shown in FIG. 1, the back side of the recording medium, i.e., the coating layer comes into contact with transfer roll 3 (a driven roll) and discharge roll 6. Supporting the higher fatty acid salt content in the coating layer exceeds 40% by weight, these rolls are apt to slip. It follows that the recording medium transfer precision is reduced, resulting in the failure of obtaining an image of high resolving power. The nip pressure F2 imposed to the recording medium by transfer roll 3 and pinch roll 4 can be increased to some extent to prevent slippage, but there is naturally a limit because the supporting strength of the rolls are structurally limited and also because an increase in nip pressure F2 leads to an increase of loss of driving force. Further, it is not desirable to increase the pressure F3 of roulette wheel 7 imposed on the recording medium; for roulette wheel 7 comes into contact with the recorded surface as stated above and will leave bites (dotted line) on the recorded surface if pressed thereto under an increased contact pressure, resulting in deteriorated image quality. Since the ink receiving layer has high ink-absorbing properties, it is softened with absorbed ink immediately after recording and is susceptible to bites. In full color recording, in particular, the ink receiving layer having absorbed inks of three colors is so much liable to bites. Therefore, the pressing force F3 of roulette wheel 7 onto the recording medium is preferably set at about 5 to 30 g per wheel. Under such a restriction put on the pressing force to be applied to the recording medium, slippage tends to occur between discharge roll 6 and the recording medium if the higher fatty acid salt content in the coating layer exceeds 40% by weight.

In other words, if the amount of the higher fatty acid salt in the coating layer is more than 40% by weight, transfer roll 3 and discharge roll 6, especially the latter, tend to slip, thus resulting in reduction in recording medium transfer precision, which leads to the failure of obtaining an image of high resolving power.

The above-described situation also applies to the apparatus shown in FIG. 2. Additionally, since feed roll 2 comes into contact with the back side of recording medium S, namely, the coating layer, cases would occur in which feed roll 2 slips on the recording medium, failing to secure certain feed if the coating layer contains more than 40% by weight of the higher fatty acid salt.

To the contrary, the coating layer of the ink jet recording medium of the first embodiment has a higher fatty acid salt content ranging from 10 to 40% by weight. Owing to this condition and the effect of the coating weight of the coating layer ranging from 0.1 to 0.3 g/m$^2$ as hereinafter described, the rubber rolls hardly slip, whereby the recording medium transfer precision (inclusive paper feed precision, hereinafter the same) is improved to obtain an image of high resolving power.

With the higher fatty acid salt content in the coating layer ranging from 10 to 40% by weight, should the coating weight of the coating layer be less than 0.1 g/m$^2$, uppermost recording medium S1 to be fed hardly slips on the lower recording medium S2 so that recording medium S2 tends to accompany recording medium S1.

To the contrary if the coating weight of the coating layer is more than 0.3 g/$^2$, uppermost recording medium S1 to be fed easily slips on underlying recording medium S2, but transfer roll 3 and discharge roll 6, especially the latter, tend to slip, thus resulting in reduction in recording medium transfer precision, which leads to the failure of obtaining an image of high resolving power. In the apparatus shown in FIG. 2, feed roller 2 also tends to slip.

Figure 3:
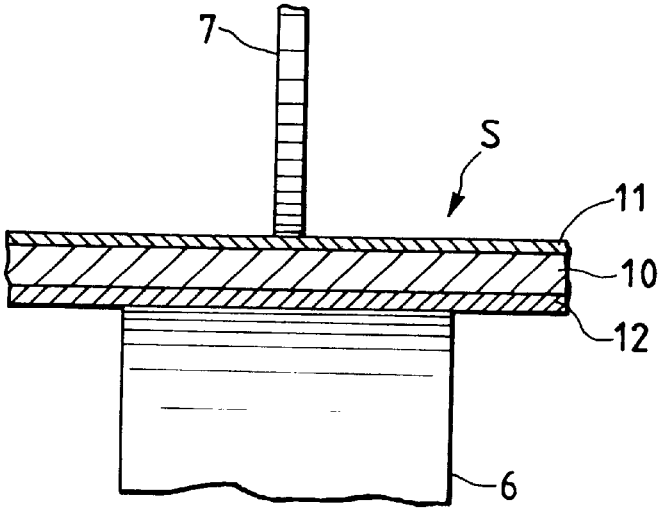
FIGS. 3 and 4 are each an illustration explaining the working action.
Figure 4:
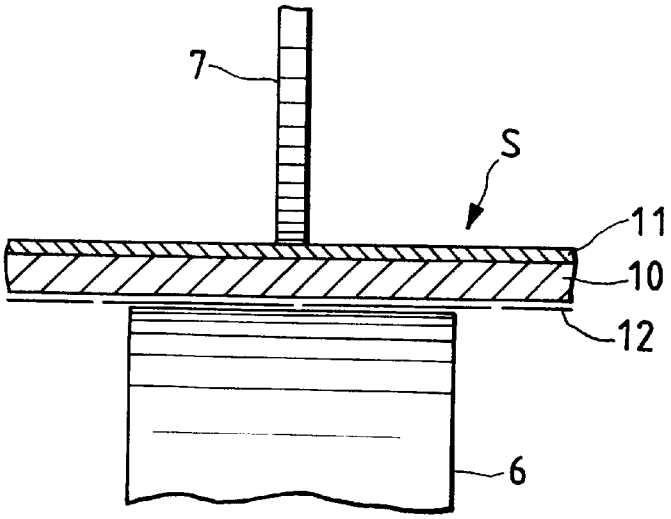

The slip of discharge roll 6 is explained in more detail by referring to FIGS. 3 and 4. FIGS. 3 and 4 are each a schematic front view of discharge roll 6 and roulette wheel 7 transferring recording medium S (left side view or right side view of FIG. 1 or 2). Numeral references 10, 11 and 12 indicate a sheet base, a recording layer, and a coating layer, respectively.

Assuming that coating layer 12 is provided to a coating weight exceeding 0.3 g/m$^2$, it has a relatively large thickness as in FIG. 3 so that discharge roll 6 contacts only coating layer 12 containing 10 to 40% by weight of a higher fatty acid salt and is thus apt to slip. Such a situation similarly applies to feed roll 2 and transfer roll 3.

According to the first embodiment, since the coating weight of the coating layer is 0.1 to 0.3 g/m$^2$, coating layer 12 is relatively thin and, so to speak, sparse on sheet base 10. Accordingly, discharge roll 6 is brought into direct contact with base 10 in parts. Because discharge roll 6 is a rubber roll, and base 10 has a relatively low degree of smoothness, some frictional force (transfer force) is assured owing to the partial direct contact thereby to transfer the recording medium certainly. This situation also applies to feed roll 2 and transfer roll 3.

As described above, according to the ink jet recording medium of the first embodiment, in which the coating layer contains 10 to 40% by weight of a higher fatty acid salt and has a coating weight of 0.1 to 0.3 g/m$^2$, transfer roll 3 and discharge roll 6 hardly slip on the recording medium to secure improved transfer precision, thereby to provide an image of high resolving power.

In other words, the ink jet recording medium of the first embodiment is prevented from being double-fed and is transferred in an ink jet recording apparatus with improved precision to provide a recorded image of high resolving power by providing on one side of the base a recording layer having an ink receiving layer whose surface is smoother than plain paper and on the other side of the base a relatively slippery coating layer containing 10 to 40% by weight of a higher fatty acid salt to a relatively small coating weight as 0.1 to 0.3 g/m$^2$.

Since the coating layer provided on the back side of the base has a reduced coating weight, the production speed can be increased to reduce the cost.

According to the second embodiment, the recording layer of the ink jet recording medium of the first embodiment comprises the aforesaid ink receiving layer and a water-repellent layer covering the ink receiving layer. Therefore, the spread of ink in the ink receiving layer is suppressed to obtain an image of further increased resolving power.

Because the ink receiving layer is covered with the water-repellent layer, moisture is apt to adhere to the surface of the water-repellent layer when the recording medium is left to stand in a high humidity environment. Particularly where the water-repellent layer is made from a silicone emulsion as in the third embodiment, the tendency of moisture adhesion is stronger, yet double feeding is prevented and improved transfer precision can be obtained to provide a recorded image of high resolving power owing to the coating layer, provided on the back side (opposite to the water-repellent layer) of the base, which contains 10 to 40% by weight of a higher fatty acid salt and has a coating weight of 0.1 to 0.3 g/m$^2$.

According to the fourth embodiment, the recording surface has a coefficient of dynamic friction of 0.65 to 0.75 in mutual friction, the back surface of the base having a coefficient of dynamic friction of 0.15 to 0.25 in mutual friction, and the coefficient of static friction between the recording surface and the back surface is 0.55 to 0.65. Therefore, feed roll 2 can be prevented from slipping on the recording medium during paper feed chiefly in the printer of the type of FIG. 1, whereby double paper feeding can be avoided, and the transfer precision can be improved to provide a recorded image of high resolving power.

In the apparatus shown in FIG. 1. recording media S are set in a pile in paper feed tray 1 with their recording side up as previously stated. Under such a condition, if the coefficient of static friction between the recording surface and the back surface exceeds 0.65, recording medium S1, the top sheet of the pile in paper feed tray 1, is apt to slip on underlying recording medium S2. It tends to follow that recording medium S2 accompanies recording medium S1 that is being fed (i.e., double feeding).

If the static coefficient of friction is less than 0.55, uppermost recording medium S1 easily slips on underlying recording medium S2. To achieve such a small static coefficient of friction, the coefficient of dynamic friction between the recording surfaces must be less than 0.65, or the coefficient of dynamic friction between the back surfaces must be less than 0.15. However, if the coefficient of dynamic friction between the recording surfaces is less than 0.65, feed roll 2 is apt to slip on recording medium S1, resulting in a failure of feeding (non-feed). If the coefficient of dynamic friction between the back surfaces is less than 0.15, transfer roll 3 and discharge roll 6, which are in contact with the back surface, especially discharge roll 6, are apt to slip. As a result, the recording medium transfer precision is reduced, and an image of high resolving power cannot be obtained.

On the other hand, if the coefficient of dynamic friction between the recording surfaces is more than 0.75, or if the coefficient of dynamic friction between the back surfaces is more than 0.25, it is difficult to reduce the coefficient of static friction between the recording surface and the back surface to less than 0.65. As a result, the double feeding occurs.

According to the fourth embodiment, the recording surface has a coefficient of dynamic friction of 0.65 to 0.75 in mutual friction, the back surface of the base has a coefficient of dynamic friction of 0.15 to 0.25 in mutual friction, and the coefficient of static friction between the recording surface and the back surface is 0.55 to 0.65. Therefore, when used mostly in a printer of the type shown in FIG. 1 in which feed roll 2 comes into contact with the recording surface, the recording medium prevents a slip of feed roll 2 thereon, is prevented from being double-fed during paper feed, and is transferred at high transfer precision to provide a recorded image of high resolving power.

According to the fifth embodiment, since the recording surface of the ink jet recording medium of the fourth embodiment has a silicone water-repellent layer, the spread of ink on the recording surface can be suppressed to achieve further improvement of resolving power.

Although moisture tends to adhere to the surface of the silicone water-repellent layer when the recording medium is left to stand in a high humidity environment, the frictional characteristics as mentioned as to the fourth embodiment prevent a slip of feed roll 2 on the recording medium and double feeding, thereby to improve the transfer precision to provide a recorded image of high resolving power.

According to the sixth embodiment, the back side of the ink jet recording medium of the fourth or fifth embodiment has a coating layer comprising 60 to 80% by weight of an aqueous binder and 20 to 40% by weight of a higher fatty acid salt. The higher fatty acid salt present in the coating layer serves as lubricant, making it easier to adjust the coefficient of dynamic friction between the back surfaces at 0.15 to 0.25 or to adjust the coefficient of static friction between the recording surface and the back surface at 0.55 to 0.65, thereby further ensuring prevention of double feeding.

According to the seventh embodiment, the base of the ink jet recording media of any one of the first to sixth embodiments is made of paper. Therefore, a base having a relatively low degree of smoothness can be obtained at a competitive price thereby providing recording media achieving high resolving power at a low cost.

The embodiments of carrying out the present invention will be explained with reference to the accompanying drawings.

Figure 5:
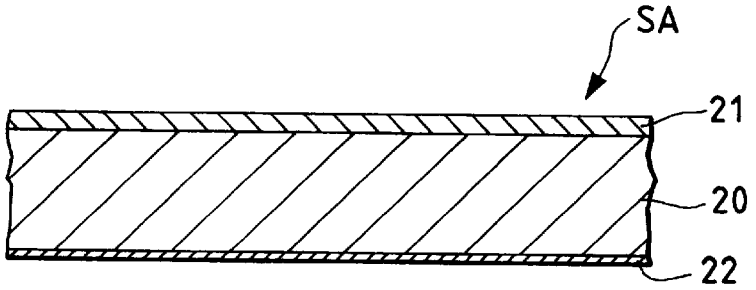
FIG. 5 is a schematic partial cross section of an example of the ink jet recording media according to the invention.

Recording Medium SA:

FIG. 5 is a schematic partial cross section of an example of the ink jet recording media according to the invention.

As shown in the figure, ink jet recording medium SA comprises base 20 having provided on one side thereof a recording layer comprising porous ink receiving layer 21 whose surface is smoother than plain paper's and on the other side thereof 0.1 to 0.3 g/m$^2$ of coating layer 22 comprising an aqueous binder containing 10 to 40% by weight of a higher fatty acid salt.

Ink receiving layer 21 can have known formulations. For example, it can comprise pigments, such as amorphous silica; water-soluble resin binders having satisfactory film-forming properties, such as PVA and polymer latices; and additives, such as cationic resins for improvement of water resistance, photo stabilizers for improvement of light resistance, and fluorescent brightening agents for improvement of whiteness.

The higher fatty acid salts used in coating layer 22 include a zinc salt, a calcium salt, a magnesium salt, a barium salt or an aluminum salt of stearic acid, myristic acid, oleic acid, and the like. The aqueous binders used in coating layer 22 include starch derivatives, such as oxidized starch and esterified starch; cellulose derivatives, such as carboxymethyl cellulose and hydroxyethyl cellulose; PVA and its derivatives; polyvinylpyrrolidone, casein, gelatin, styrene-butadiene latices, acrylate emulsions, styrene-acrylate emulsions, and vinyl acetate emulsions.

The higher fatty acid salt is used in an amount of 10 to 40% by weight, preferably 20 to 40% by weight, based on 60 to 90% by weight of the aqueous binder.

The coating layer is provided to a coating weight of 0.1 to 0.3 g/m$^2$, preferably 0.2 to 0.3 g/m$^2$.

Coating can be performed by an appropriately selected coating technique using known coaters, e.g., a blade coater, an air knife coater, a roll coater, a kiss-roll coater, a squeeze coater, a curtain coater, a bar coater, a gravure coater, and a comma coater. Ink receiving layer 21 can also be provided similarly.

Figure 6:
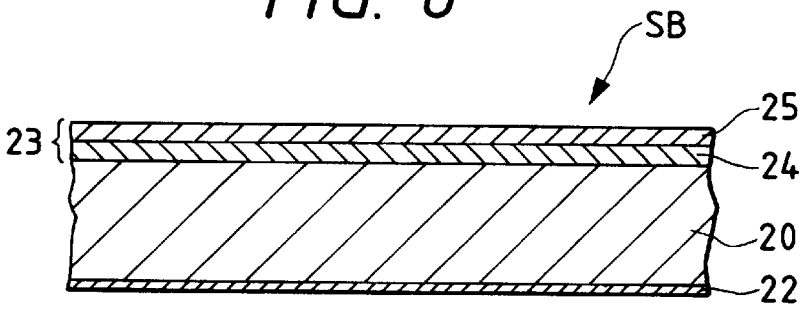
FIG. 6 is a schematic partial cross section of another example of the ink jet recording media according to the invention.

Recording Medium SB:

FIG. 6 is a schematic partial cross section of another example of the ink jet recording media of the present invention. The same reference numerals as used in FIG. 5 are given to the same members of FIG. 6, and the explanation thereof is omitted.

The difference between recording medium SB from the above-mentioned embodiment, recording medium SA, resides in that recording layer 23 consists of ink receiving layer 24 and water-repellent layer 25 covering the ink receiving layer 24.

The pigment used in ink receiving layer 24 is preferably synthetic silica, such as non-crystalline silica or amorphous silica. The term "synthetic silica" as used here includes silica gel, white carbon, and anhydrous silica which are described in The Chemical Society of Japan (ed.), *Chemical Handbook, Applied Chemistry*, Maruzen Co., p. 256 (1986). White carbon is particularly preferred. Ink receiving layer 24 also contains an aqueous binder. The aqueous binder to be used is not particularly limited as far as it is an aqueous binder. Examples of useful aqueous binders are starch derivatives, such as oxidized starch and esterified starch; cellulose derivatives, such as carboxymethyl cellulose and hydroxyethyl cellulose; PVA and its derivatives; polyvinylpyrrolidone, casein, gelatin, styrene-butadiene latices, acrylate emulsions, and vinyl acetate emulsions. The aqueous binder is preferably used in a proportion of 10 to 100 parts by weight per 100 parts by weight of silica. While the optimum proportion of the binder is subject to variation within the above range, it is not particularly limited as far as sufficient binding action can be obtained and the porous structure for ink absorption is not destroyed. The coating composition for forming ink receiving layer 24 comprises the above-described silica and binder and is prepared as an aqueous coating composition. If desired, the coating composition may appropriately contain pigment dispersants, water-retaining agents, thickeners, defoaming agents, antiseptics, colorants, water resistance-imparting agents, wetting agents, fluorescent dyes, ultraviolet absorbers, cationic polyelectrolytes, and the like. The coating composition is applied to a solid coating weight of 10 to 25 g/m$^2$, preferably 13 to 22 g/m$^2$. Too much a coating weight reduces the image density. If the coating weight is too small, ink absorption is insufficient.

The water repellant used in water-repellent layer 25 is an aqueous water repellant, such as silicone resins and higher fatty acid compounds, with a silicone emulsion being preferred. The water repellant is applied to such a coating weight that could adjust the size of ink dots to a proper range, usually to a solid coating weight of 0.1 to 2.0 g/m$^2$, preferably 0.2 to 1.5 g/m$^2$.

The same coating techniques as described as to recording medium SA can be used for the formation of water-repellent layer 25.

Figure 7:
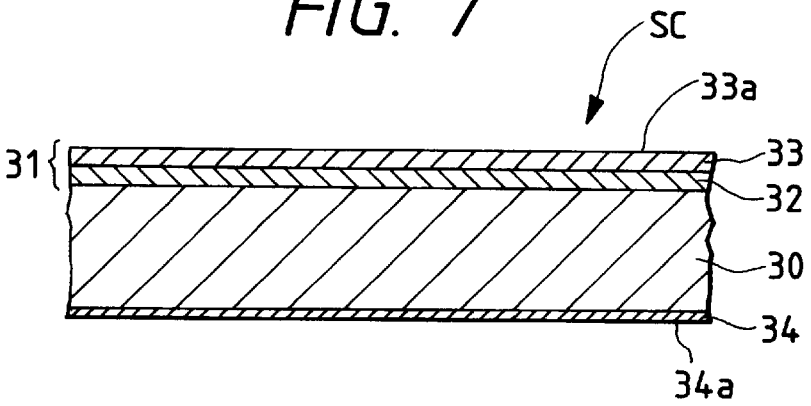
FIG. 7 is a schematic partial cross section of still another example of the ink jet recording media according to the invention.

Recording Medium SC:

FIG. 7 is a schematic partial cross section of still another embodiment of the ink jet recording media of the present invention.

As shown in FIG. 7, ink jet recording medium SC has recording layer 31 only on one side of base 30, and the recording layer 31 has ink receiving layer 32 and a silicon water-repellent layer 33 covering the ink receiving layer 32. That is, the surface of water-repellent layer 33 forms recording surface 33*a*.

On the opposite side of base 30 is provided coating layer 34 comprising 60 to 80% by weight of an aqueous binder and 20 to 40% by weight of a higher fatty acid salt. That is, the surface of coating layer 34 forms back surface 34*a* of recording medium SC.

Recording medium SC is characterized in that the coefficient of dynamic friction between recording surfaces 33*a* is 0.65 to 0.75, the coefficient of dynamic friction between back surfaces 34*a* is 0.15 to 0.25, and the coefficient of static friction between recording surface 33*a* and back surface 34*a* is 0.55 to 0.65.

While ink receiving layer 32 can be formed in the same manner as for ink receiving layer 21 or 24 of recording medium SA or SB, the pigments which can be used here include silica, synthetic silicates, talc, kaolin, clay, ground calcium carbonate, precipitated calcium carbonate, other carbonates, acid clay, aluminum hydroxide, diatomaceous earth, titanium dioxide, zinc oxide, and barium sulfate.

Water-repellent layer 33 can be formed in the same manner as for water-repellent layer 25 of recording medium SB, except that the surface thereof (33*a*) has a coefficient of dynamic friction of 0.65 to 0.75 in mutual friction.

Coating layer 34 can be formed of the same materials as used in the formation of coating layer 22 of recording layer SA, except that it comprises 60 to 80% by weight of an aqueous binder and 20 to 40% by weight of a higher fatty acid salt and that the surface thereof (34*a*) has a coefficient of dynamic friction of 0.15 to 0.25 in mutual friction. Coating layer 34 is applied to a coating weight usually of 0.1 to 0.3 g/m$^2$, preferably 0.2 to 0.3 g/m$^2$.

In the present invention, the basis weight of the base (paper) is preferably from 80 to 160 g/m$^2$.

EXAMPLES

The present invention will now be explained in greater detail by way of Examples in view of Comparative Examples. Unless otherwise indicated herein, all the parts, percents, and ratios are by weight.

Examples A1 and A2 and Comparative Examples A1 and A2 relate to the above-mentioned recording medium SA. A sheet used in these Examples and Comparative Examples in common (hereinafter referred to as common sheet) was prepared as follows.

A paper stock comprising 85 parts (by weight, hereinafter the same) of LBKP (Hardwood Bleached Sulfate Pulp, C.S.F.: 300 ml), 15 parts of precipitated calcium carbonate, 0.02 part of a sizing agent (of alkyl ketene dimer type), 1.0 part of aluminum sulfate, and 0.5 part of cationic starch was made into paper having a basis weight of 80 g/m$^2$ by means of Fourdrinier paper machine.

Separately, 100 parts of synthetic silica ("Finesil X-37" produced by Tokuyama Corp.) was dispersed in 340 parts of water. The resulting pigment dispersion was mixed with a solution of 10 parts of a styrene-butadiene latex ("S-2750" produced by Japan Synthetic Rubber Co., Ltd.) and 40 parts of polyvinyl alcohol ("PVA105" produced by Kuraray Co., Ltd.) as aqueous binders in 350 parts of water. To the mixture were further added a bluing dye and a fluorescent dye to prepare a coating composition. The coating composition was applied to the above prepared paper with a roll coater and dried to form an ink receiving layer to prepare a common sheet. The coating weight of the ink receiving layer was 15 g/m$^2$.

EXAMPLE A1

A coating composition for formation of a coating layer on the back side (hereinafter referred to as a back coating composition) was prepared by mixing 10 parts of a calcium stearate emulsion ("Nopco SYC" produced by San-Nopco Co., Ltd.) and 90 parts of an acrylate emulsion ("Mowinyl 710" produced by Hoechst Gosei K.K.) and diluting the mixture to a 3% concentration. The resulting back coating composition was applied to the back side of the common sheet and dried to obtain ink jet recording medium A1. The coating weight on the back side was 0.20 g/m$^2$.

EXAMPLE A2

Ink jet recording medium A2 was obtained in the same manner as in Example A1, except that the lubricant/binder ratio of the back coating composition was changed to 40/60 and the coating weight was changed to 0.10 g/m$^2$.

Comparative Example A1

A comparative ink jet recording medium was obtained in the same manner as in Example A1, except that the lubricant/binder ratio of the back coating composition was changed to 5/95 and the coating weight was changed to 0.40 g/m$^2$.

COMPARATIVE EXAMPLE A2

A comparative ink jet recording medium was obtained in the same manner as in Example A1, except that the lubricant/binder ratio of the back coating composition was changed to 10/90 and the coating weight was changed to 0.50 g/m$^2$.

Examples B1 to B4 and Comparative Examples B1 to B3 relate to the above-described recording medium SB. A common sheet used in these Examples and Comparative Examples was prepared by further coating the ink receiving layer of the common sheet used in Examples of recording medium SA with a 2% solution of a polydimethylsiloxane emulsion ("SM7060" produced by Toray-Dow Corning Silicone Co., Ltd.) to form water-repellent layer 25.

EXAMPLE B1

Ink jet recording medium B1 was obtained in the same manner as in Example A1, except for using polyvinyl alcohol ("PVA105" produced by Kuraray Co., Ltd.) as a binder of the back coating composition, changing the lubricant/binder ratio to 15/85, and changing the coating weight to 0.28 g/m$^2$.

EXAMPLE B2

Ink jet recording medium B2 was obtained in the same manner as in Example B1, except for using a zinc stearate emulsion ("Hidorin Z-7-30" produced by Chukyo Yushi Co., Ltd.) as a lubricant of the back coating composition, changing the lubricant/binder ratio to 20/80, and changing the coating weight to 0.11 g/m$^2$.

EXAMPLE B3

Ink jet recording medium B3 was obtained in the same manner as in Example B1, except for changing the lubricant/binder ratio to 25/75 and changing the coating weight to 0.20 g/m$^2$.

EXAMPLE B4

Ink jet recording medium B4 was obtained in the same manner as in Example B1, except for changing the lubricant/binder ratio to 35/65 and changing the coating weight to 0.30 g/m$^2$.

COMPARATIVE EXAMPLE B1

A comparative ink jet recording medium was obtained in the same manner as in Example B1, except for changing the lubricant/binder ratio to 10/90 and changing the coating weight to 0.05 g/m$^2$.

COMPARATIVE EXAMPLE B2

A comparative ink jet recording medium was obtained in the same manner as in Example B1, except for changing the lubricant/binder ratio to 50/50 and changing the coating weight to 0.30 g/m$^2$.

COMPARATIVE EXAMPLE B3

A comparative ink jet recording medium was obtained in the same manner as in Example B1, except for changing the lubricant/binder ratio to 0/100 and changing the coating weight to 0.20 g/m$^2$.

The ink jet recording media prepared in the foregoing Examples and Comparative Examples were evaluated on ink jet printers 1 or 2.

Figure 8:
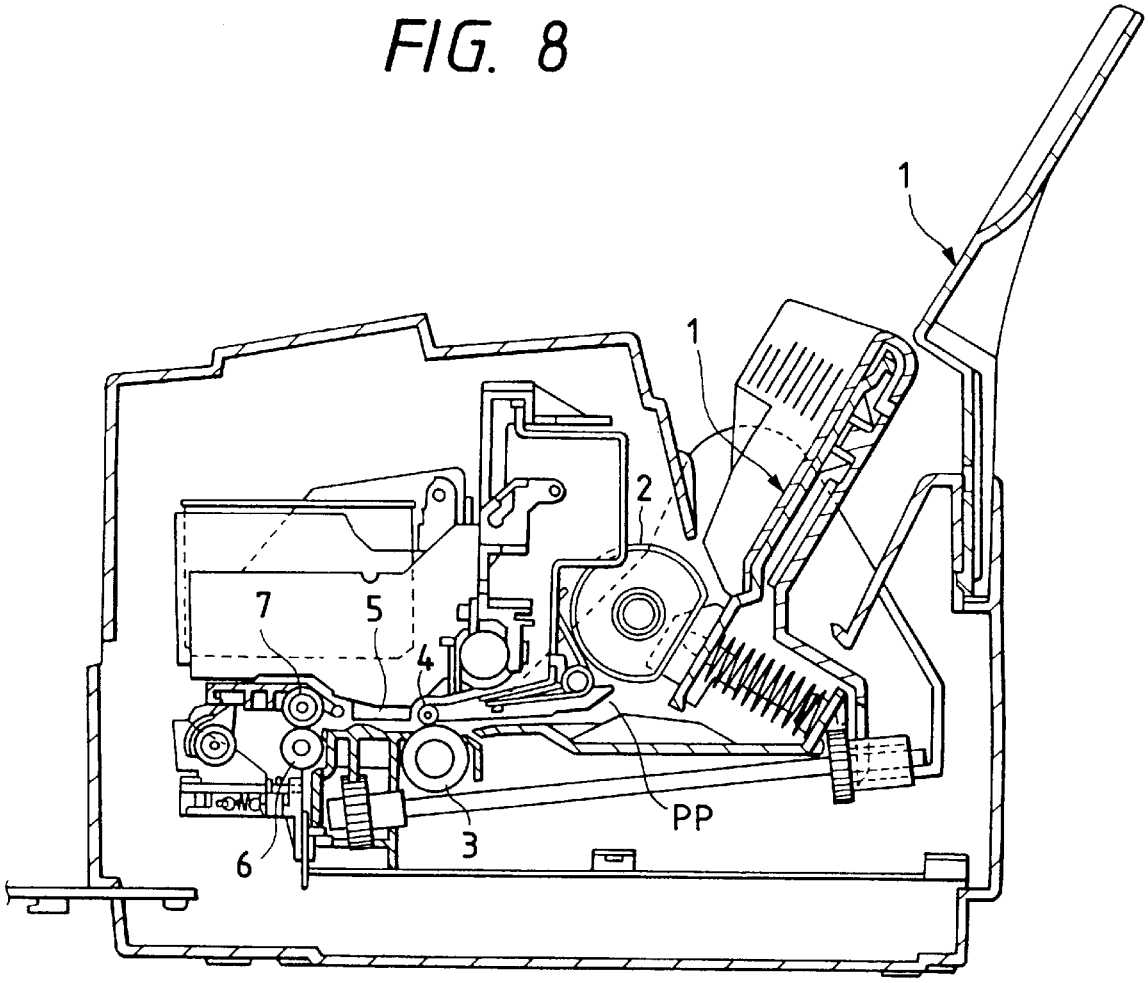
FIG. 8 is a side view of the inside structure of an example of an ink jet printer.

Ink Jet Printer 1:

FIG. 8 shows a side view of the inside structure of ink jet printer 1 used for evaluation. This printer is of the same type as the apparatus shown in FIG. 1, and the same reference numerals in FIG. 1 are given to the same members of FIG. 8. In FIG. 8, "PP" represents a sheet conveying pass.

Figure 9:
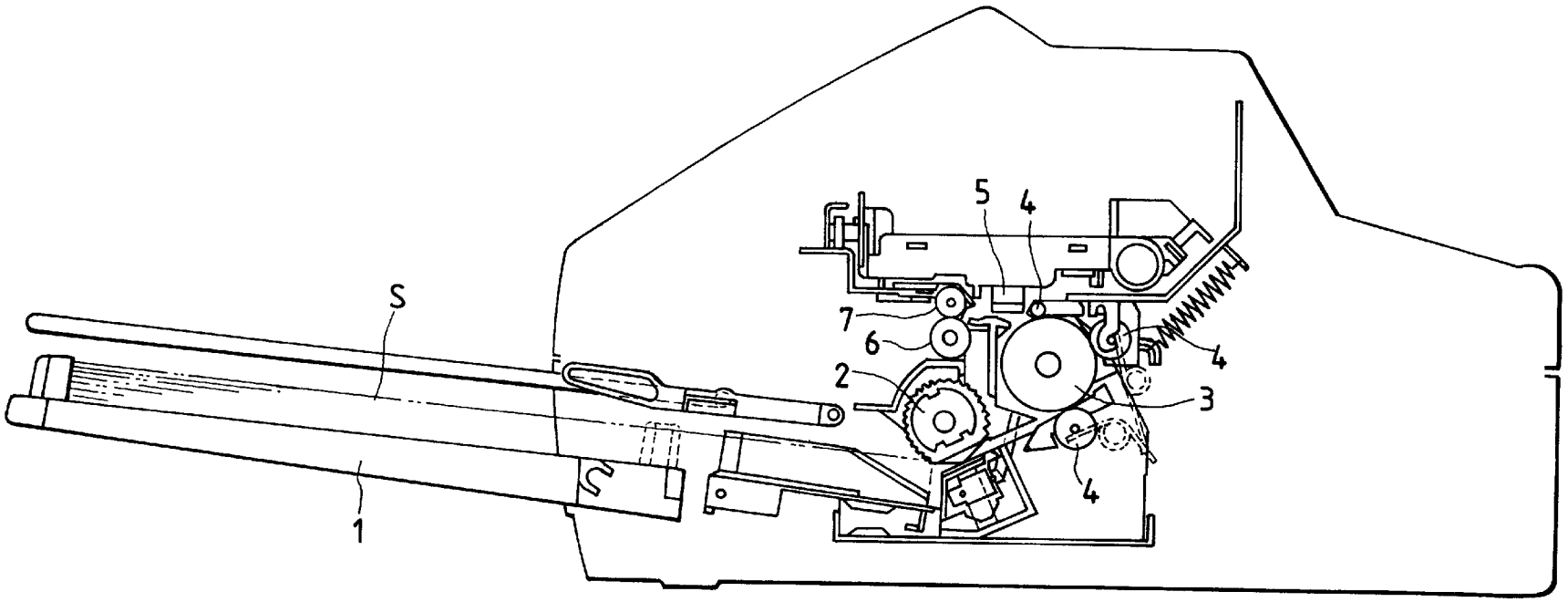
FIG. 9 is a side view of the inside structure of another example of an ink jet printer.

Ink Jet Printer 2:

FIG. 9 shows a side view of the inside structure of ink jet printer 2 used for evaluation. This printer is of the same type as the apparatus shown in FIG. 2, and the same reference numerals in FIG. 2 are given to the same members of FIG. 9.

The recording media were tested on each of ink jet printers 1 and 2 under a normal ambient temperature and humidity condition (20° C., 65% RH) or a high temperature and humidity condition (32° C., 80% RH), and occurrence of double feeding and slippage (slippage in feed and transfer) was observed. The results obtained are shown in Table 1 below. In Table 1, symbol "o" indicates that neither double feeding nor slippage occurred at all, and symbol "X" indicates that double feeding or slippage occurred. Symbols before the slash (/) are the results of the test on printer 1, and those after the slash are the results of the test on printer 2. For example, "o/X" means the result of the test on printer 1 was o and the result of the test on printer 2 was X.

TABLE 1

| | Back Coating Layer | | Ambient Temp. & Humidity | | High Temp. & Humidity | |
|---|---|---|---|---|---|---|
| | Lubricant/ Binder Ratio | Coating Weight (g/m$^2$) | (20° C., 65% RH) Double Feed | Slip-page | (32° C., 80% RH) Double Feed | Slip-page |
| Example A1 | 10/90 | 0.20 | ○/○ | ○/○ | ○/○ | ○/○ |
| Example A2 | 40/60 | 0.30 | ○/○ | ○/○ | ○/○ | ○/○ |
| Example B1 | 15/85 | 0.28 | ○/○ | ○/○ | ○/○ | ○/○ |
| Example B2 | 20/80 | 0.11 | ○/○ | ○/○ | ○/○ | ○/○ |
| Example B3 | 25/75 | 0.20 | ○/○ | ○/○ | ○/○ | ○/○ |
| Example B4 | 35/65 | 0.30 | ○/○ | ○/○ | ○/○ | ○/○ |
| Compara. Example A1 | 5/95 | 0.40 | X/X | ○/○ | X/X | ○/○ |
| Compara. Example A2 | 10/90 | 0.50 | ○/○ | X/X | ○/○ | X/X |
| Compara. Example B1 | 10/90 | 0.05 | X/X | ○/○ | X/X | ○/○ |
| Compara. Example B2 | 50/50 | 0.30 | X/○ | X/X | X/○ | X/X |
| Compara. Example B3 | 0/100 | 0.20 | X/X | ○/○ | X/X | ○/○ |

Examples C1 to C3 and Comparative Examples C1 to C4 relate to the above-described recording medium SC. The same common sheet as used in Examples B was used unless otherwise described.

EXAMPLE C1

A back coating composition was prepared by mixing 25 parts of a calcium stearate emulsion ("Nopco SYC" produced by San-Nopco Co., Ltd.) and 75 parts of an acrylate emulsion ("Mowinyl 710" produced by Hoechst Gosei K. K.) and diluting the mixture to a 3% concentration. The resulting back coating composition was applied to the back side of the common sheet and dried to obtain ink jet recording medium C1. The coating weight on the back side was 0.2 g/m$^2$.

EXAMPLE C2

Ink jet recording medium C2 was obtained in the same manner as in Example C1, except for using polyvinyl alcohol ("PVA105" produced by Kuraray Co., Ltd.) as a binder of the back coating composition.

EXAMPLE C3

Ink jet recording medium C3 was obtained in the same manner as in Example C1, except for using a zinc stearate emulsion ("Hidorin Z-7-30" produced by Chukyo Yushi Co., Ltd.) as a lubricant of the back coating composition, changing the lubricant/binder ratio to 35/65, and changing the coating weight to 0.3 g/m$^2$.

COMPARATIVE EXAMPLE C1

A comparative ink jet recording medium was obtained by applying a 2% solution of polyvinyl alcohol ("PVA105"

produced by Kuraray Co., Ltd.) to the back side of the common sheet used in Example A1 (a sheet having no water-repellent layer). The coating weight on the back side was 0.2 g/m$^2$.

COMPARATIVE EXAMPLE C2

The common sheet used in Example B1, i.e., a sheet having a water-repellent layer, was used as such as a comparative ink jet recording medium.

COMPARATIVE EXAMPLE C3

A comparative ink jet recording medium was obtained in the same manner as in Example C2, except that the sheet had no water-repellent layer and a zinc stearate emulsion was used as a higher fatty acid salt.

COMPARATIVE EXAMPLE C4

A comparative ink jet recording medium was obtained in the same manner as in Example C1, except for changing the lubricant/binder ratio to 50/50 and changing the coating weight to 0.2 g/m$^2$.

Recording on the recording media obtained in Examples C1 to C3 and Comparative Examples C1 to C4 was carried out on Mach Jet Color Printer MJ-5000C, manufactured by Seiko Epson Corporation. The recorded image quality and transfer properties in the printer were evaluated according to the following standard. Coefficients of dynamic and static friction of the recording media were measured with Tensilon in accordance with a testing method for pulp and paper No. 30–79 of J. TAPPI. The results of the evaluation and measurement are shown in Table 2.

Standard of Evaluation:

Image quality was evaluated by printing a single dot-thick line and measuring the line width at 5 points with Image Analyzer (a trade name of ADS) to obtain an average.

Transfer properties were evaluated from occurrence of non-feed or slippage in paper feeding.

In Table 2, "o" means that neither non-feed nor slippage occurred, and "X" means that non-feed and/or slippage occurred.

TABLE 2

| | Back Coating Layer | | | Recording/Recording Surfaces | Back/Back Surfaces | Recording/Back Surfaces | |
|---|---|---|---|---|---|---|---|
| | Lubricant/Binder Ratio | Coating Weight (g/m$^2$) | Line Width ($\mu$m) | Dynamic Friction Coefficient | Dynamic Friction Coefficient | Static Friction Coefficient | Transfer Properties |
| Example C1 | 25/75 | 0.2 | 68 | 0.69 | 0.21 | 0.59 | ○ |
| Example C2 | 25/75 | 0.2 | 72 | 0.72 | 0.18 | 0.61 | ○ |
| Example C3 | 35/65 | 0.3 | 70 | 0.71 | 0.16 | 0.57 | ○ |
| Compara. Example C1 | 0/100 | 0.2 | 130 | 0.60 | 0.52 | 0.60 | X |
| Compara. Example C2 | — | — | 74 | 0.69 | 0.50 | 0.71 | X |
| Compara. Example C3 | 25/75 | 0.2 | 126 | 0.60 | 0.20 | 0.49 | X |
| Compara. Example C4 | 50/50 | 0.3 | 67 | 0.69 | 0.11 | 0.46 | X |

Effect of the Invention:

The ink jet recording medium according to the first embodiment of the invention is prevented from being double-fed and can be transferred at improved precision notwithstanding the smoother surface of its recording layer than plain paper's, thereby providing high quality images.

Further, since the coating layer on the back side of the recording medium has a reduced thickness, the production speed can be so increased to reduce the cost.

The ink jet recording medium according to the second embodiment of the invention is prevented from being double-fed and can be transferred at improved precision notwithstanding the presence of the water-repellent layer covering the ink receiving layer, thereby providing further improved image quality. The effect is particularly conspicuous where the water-repellent layer is formed of a silicon emulsion as in the third embodiment.

The ink jet recording layer according to the fourth embodiment of the invention is freed from feed trouble and can be transferred at improved precision, thereby providing images of high resolving power.

The ink jet recording medium according to the fifth embodiment of the invention is prevented from being double-fed and can be transferred at improved precision notwithstanding the presence of a water-repellent layer on the recording layer, thereby to provide images of further improved quality.

The ink jet recording medium according to the sixth embodiment of the invention can easily have the coefficient of dynamic friction between the back surfaces adjusted at 0.15 to 0.25 and have the coefficient of static friction between the recording surface and the back surface adjusted at 0.55 to 0.65, thereby further ensuring prevention of double feeding.

According to the seventh embodiment of the invention, the ink jet recording medium of any one of the first to sixth embodiments of the invention can be produced at a low cost.

While the invention has been described in detail and with reference to specific examples thereof, it will be apparent to one skilled in the art that various changes and modifications can be made therein without departing from the spirit and scope thereof.

What is claimed is:

1. An ink jet recording medium comprising a base having provided on one side thereof a recording layer having an ink receiving layer whose surface is smoother than the surface of plain paper and on the other side thereof a coating layer formed from an aqueous binder containing 10 to 40% by weight of a higher fatty acid salt to a coating weight of 0.1 to 0.3 g/m$^2$.

2. The ink jet recording medium according to claim 1, wherein said aqueous binder contains 15 to 40% by weight of a higher fatty acid.

3. An ink jet recording medium comprising a base having provided on one side thereof a recording layer having an ink receiving layer whose surface is smoother than the surface of plain paper and on the other side thereof a coating layer formed from an aqueous binder containing 10 to 40% by weight of a higher fatty acid salt to a coating weight of 0.1 to 0.3 $g/m^2$, wherein said recording layer is composed of said ink receiving layer and a water-repellent layer covering said ink receiving layer.

4. The ink jet recording medium according to claim 3, wherein said water-repellent layer is formed of a silicone emulsion.

5. The ink jet recording medium according to claim 3, wherein said aqueous binder contains 15 to 40% by weight of a higher fatty acid.

6. An ink jet recording medium comprising a base having provided on only one side thereof a recording layer, said recording layer having a coefficient of dynamic friction of 0.65 to 0.75 in mutual friction, the back surface of said base having a coefficient of dynamic friction of 0.15 to 0.25 in mutual friction, and the coefficient of static friction between said recording layer and said back surface is 0.55 to 0.65.

7. The ink jet recording medium according to claim 6, wherein said recording layer has a silicone water-repellent layer.

8. The ink jet recording medium according to claim 7, wherein said back side has a coating layer formed from 60 to 80% by weight of an aqueous binder and 20 to 40% by weight of a higher fatty acid salt.

9. The ink jet recording medium according to claim 6, wherein said back side has a coating layer formed from 60 to 80% by weight of an aqueous binder and 20 to 40% by weight of a higher fatty acid salt.

10. The ink jet recording medium according to any one of claims 1 to 9, wherein said base is paper.

* * * * *